US009932212B2

(12) United States Patent
Miller

(10) Patent No.: US 9,932,212 B2
(45) Date of Patent: Apr. 3, 2018

(54) MECHANICAL OVERLOAD SENSOR SYSTEM

(71) Applicant: Ramsey Winch Company, Tulsa, OK (US)

(72) Inventor: Jonathan A. Miller, Skiatook, OK (US)

(73) Assignee: Ramsey Winch Company, Tulsa, OK (US)

( * ) Notice: Subject to any disclaimer, the term of this patent is extended or adjusted under 35 U.S.C. 154(b) by 272 days.

(21) Appl. No.: 14/932,607

(22) Filed: Nov. 4, 2015

(65) Prior Publication Data

US 2016/0130122 A1 May 12, 2016

Related U.S. Application Data

(60) Provisional application No. 62/076,189, filed on Nov. 6, 2014.

(51) Int. Cl.

| | |
|---|---|
| ***B66D 1/12*** | (2006.01) |
| ***B66D 1/58*** | (2006.01) |
| ***B66D 1/22*** | (2006.01) |

(52) U.S. Cl.

CPC ..... *B66D 1/58* (2013.01); *B66D 1/12* (2013.01); *B66D 1/22* (2013.01)

(58) Field of Classification Search

CPC ... B66D 1/12; B66D 1/22; B66D 1/24; B66D 1/56; B66D 1/58

See application file for complete search history.

(56) References Cited

U.S. PATENT DOCUMENTS

| | | | | | |
|---|---|---|---|---|---|
| 2,865,232 | A | | 12/1958 | Nardone | |
| 2,908,853 | A | * | 10/1959 | Laky | B66D 1/58 192/150 |
| 3,064,778 | A | * | 11/1962 | Gilreath | B66D 1/08 192/61 |
| 3,309,066 | A | | 3/1967 | Carlson | |
| 3,912,093 | A | * | 10/1975 | Kruschke | B60P 1/5428 212/245 |
| 4,305,513 | A | | 12/1981 | Voelz | |
| 4,483,518 | A | * | 11/1984 | Geschwind | B66D 1/58 254/274 |
| 4,821,842 | A | | 4/1989 | Cavalieri | |
| 5,361,565 | A | | 11/1994 | Bayer | |

FOREIGN PATENT DOCUMENTS

| | | |
|---|---|---|
| JP | 2004196513 | 7/2004 |
| JP | 2006315803 | 11/2006 |
| RU | 2144901 C1 | 1/2000 |
| SU | 1463713 A | 3/1989 |

* cited by examiner

*Primary Examiner* — Emmanuel M Marcelo
(74) *Attorney, Agent, or Firm* — Gable Gotwals

(57) ABSTRACT

A mechanical overload sensor system for a planetary winch having a biasing means that when overcome by the force on a ring gear, opens an electric switch which terminates power to the winch.

13 Claims, 2 Drawing Sheets

MECHANICAL OVERLOAD SENSOR SYSTEM

CROSS-REFERENCE TO RELATED APPLICATIONS

The present application is a continuation-in-part of U.S. Provisional Patent Application No. 62/076,189 filed on Nov. 6, 2014. This parent application is incorporated herein by reference.

FIELD OF THE INVENTION

The present invention relates generally to a mechanical overload sensor. More particularly, the present invention relates to a mechanical overload sensor for a planetary gear winch.

BACKGROUND OF THE INVENTION

Winches are commonly used to lift and pull heavy loads. When they are overloaded they can fail in numerous ways which can lead to property damage and personal injury. Therefore, an overload sensor can provide an important safety feature. Because many winches are powered by an electric motor, the overload sensing is typically accomplished by monitoring how much electric power the motor is drawing. When the power draw of the motor exceeds a certain predetermined amount, the power to it is terminated. This stops the overload situation.

One drawback to this form of monitoring is its intrinsic inaccuracy. The measurement of the winch's load by measuring the power draw is susceptible to inaccuracies arising from power supply issues and bad electrical connections. It can also require complicated circuits and microprocessors.

What is needed, therefore, is a simple and direct way to measure the load on a winch while in operation.

DESCRIPTION OF THE INVENTION

The present invention achieves its objections by providing a system for directly measuring the load on the winch and terminating the power to the winch when an overload occurs. It is best shown in the attached drawing. In the preferred embodiment shown it is being used on a winch with a planetary gear drive. The pull of the rope force and the drum rotation are indicated to the right of the drawing. When the winch is reeling in the rope (i.e. pulling), the force of the pull causes the ring gear to want to rotate counter clockwise. If the force of the pull or load is too great, it will exceed the force being placed on the tab of the ring gear by the plunger. This results in the tab of the ring gear moving away from the switch mounted in the gear case. This causes the switch to open and stop the flow of electricity to the motor, thus stopping the rotation of the winch.

The load required to stop the winch can be varied by altering the amount of force being placed on the tab of the ring gear. This force is created by a biasing means.

If the rope on the winch is wound in the other direction (over-wound), the present invention can be set up by moving the switch to a second location in the gear case and moving the biasing means to a second passageway in the case.

The present invention provides a direct measurement of the load on the winch using a simple electric switch. Further, it is protected from the elements and physical abuse by the case of the winch.

BRIEF DESCRIPTION OF THE DRAWINGS

Other features, aspects, and advantages of the present invention will become better understood with regard to the following detailed description, appended claims, and accompanying drawings (which are not to scale) where:

DETAILED DESCRIPTION OF THE PREFERRED EMBODIMENT(S)

Figure 1:
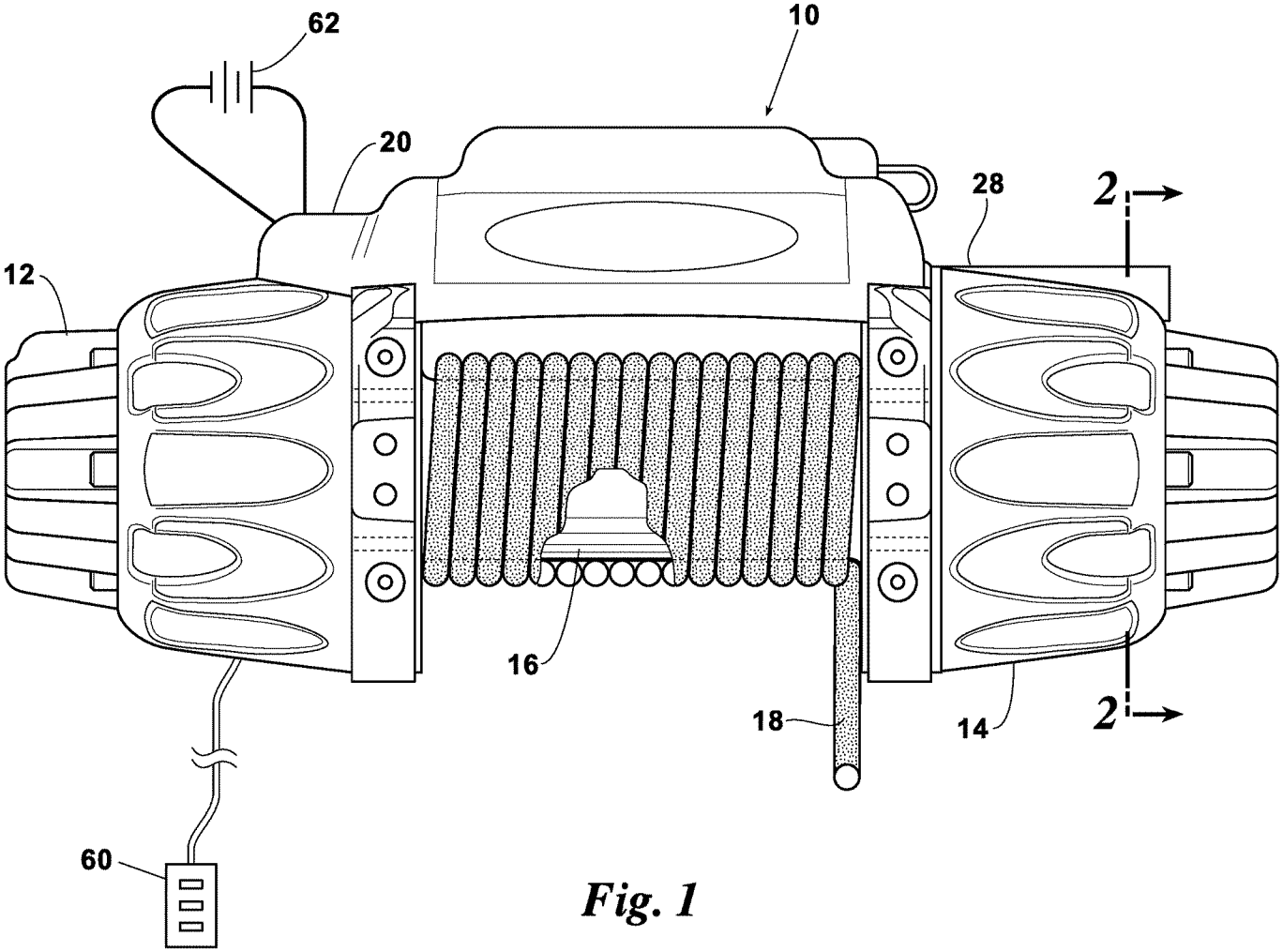
FIG. 1 is a perspective view of a planetary winch with the present invention.

Turning now to the drawings wherein like reference characters indicate like or similar parts throughout, FIG. 1 a winch 10 with an electric motor 12 driving a planetary gear train 14. The motor 12 obtains mechanical advantage over the load through the gearing in the planetary gear train 14 and the diameter of the drum 16 carrying the line 18. The calculation of this mechanical advantage is known in the art.

The motor 12 is located on a first side 20 of the winch 10. The drive shaft 22 passes through the open center of the drum 16 and connects to the sun gear 26 of the planetary gear train 14. The planet gear is located on the second side 28 of the winch 10. The planetary gear train 14 has a ring gear 30 and a plurality of planet gears 32. The planet gears 32 are each mounted on a planet carrier 24 via a planet pin 34. The ring gear 30 encircles the planet gears 32. The ring gear 30 is anchored to the case 36 of the winch 10 by one or more tabs 38.

Figure 2:
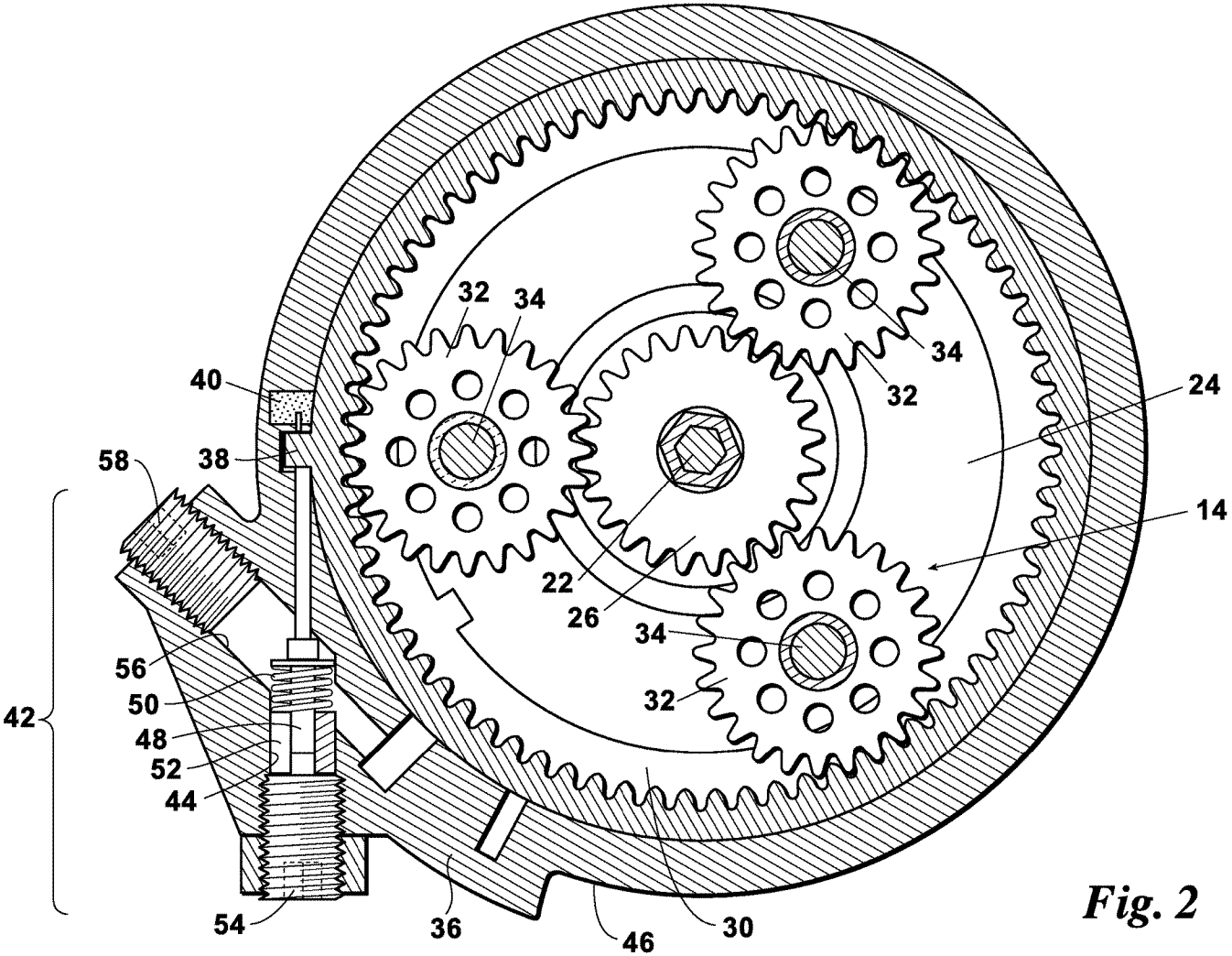
FIG. 2 is a sectional view of a planetary gear winch with mechanical overload sensor of the present invention.

To retrieve line 18 the motor 12 turns the drive shaft 22 and sun gear 26 in a counter-clockwise direction as seen in FIG. 2. This causes the planet gears 32 to rotate around their respective planet pins 34 and orbit about the sun gear 26. As the planet gears 32 orbit in a clockwise direction. This causes the drum 16 to rotate in a clockwise direction along with the planet gears 32 and pins 34. Thus, the line 18 will be wound onto the drum 16. This causes the ring gear 30 to want to rotate counter-clockwise.

In the preferred embodiment, a switch 40 is located in the case 36 of the winch 10. This switch 40 controls whether the motor 12 is provided with electricity. A biasing means 42 pushes the tab 38 of the ring gear 30 against the switch 40 causing the switch to remain closed. When force of winding the line 18 onto the drum 16 becomes too great it will overcome the force of the biasing means 42 pushing on the tab 38. This causes the tab 38 to move away from the switch 40 and for the switch 40 to open. When the switch 40 opens the power supply to the motor 12 is interrupted and the winch 10 stops retrieving the line 18. The maximum load of the winch 10 can be set by varying the force exerted by the biasing means 42.

In the preferred embodiment shown in FIG. 2, the biasing means 42 is contained in a passageway 44 within the winch case 36 extending from the tab 38 on the ring gear 30 to the exterior 46 of the case 36. The passageway 44 extends tangentially away from the ring gear 30.

The biasing means has a plunger 48, spring 50, plunger pilot 52 and adjustment set screw 54. The plunger 48 extends through the passageway 44 and into contact with the tab 38. The plunger 48 slidingly engages with the plunger pilot 52. The spring 50 is captured between the plunger 48 and the plunger pilot 52 thus exerting a force between these two parts. The adjustment set screw 54 threadedly engages with the passageway 44 and bears against the plunger pilot 52. By adjusting the location of the adjustment set screw 54 in the passageway 44, the location of the plunger 48 and the force exerted on the tab 38 can be adjusted.

In the preferred embodiment shown in FIG. 2, the spring 50 is comprised of a plurality of belleville washers, however other types of hardware, including but not limited to a spring, could also be used as a spring 50 in this arrangement.

The winch shown in FIGS. 1 and 2 are shown in an under wound configuration, i.e. the line 18 is retrieved by rotating the drum 16 clockwise. The case may be provided with a second passageway 56 extending tangentially from the ring gear 30 in the opposite direction as the first passageway 44. It has a second adjustment set screw 58 to keep out debris when not used. The second passageway 56 is used if the winch 10 is set up in an over wound configuration, i.e. the line 18 is retrieved by rotating the drum 16 in the counter-clockwise direction. FIG. 2 shows the first and second passageways 44 and 56 intersecting. However, they could be located separate from one another.

If the winch 10 is set up in an over wound configuration, the biasing means 42 would be moved from the first passageway 44 to the second passageway 56. The ring gear 30 would be rotated such that the tab 38 was located at the end of the second passageway 56. The switch 40 would also be relocated such that it was next to the tab 38. Thus, the overload mechanism would operate in the same manner as explained above, but in the opposite direction of rotation.

The controls 60 provide the operator with an interface with the winch 10. The controls 60 may be hardwired or wireless. A power source 62 provides power to the motor 12. The direction of rotation of the motor 12 and drum 16 can be changed by changing the polarity of the power. Under normal operation, the switch 40 remains closed due to the force of the plunger 48. When the load on the line 18 exceeds the preset maximum, the tab 38 and plunger 48 move away from the switch 40 causing it to open and interrupt the power being supplied to the motor 12.

For ease of explanation the present invention has been explained in the application of a planetary gear drive with a single planetary gear set. However, it is common practice to use a plurality of planetary gear sets in series in the planetary gear drive of a planetary winch 10. Each planetary gear set has a sun gear, a planet gear, planet carrier and a ring gear. The rotational force from the motor 12 passes through each of these planetary gear sets. Each set provides additional mechanical advantage for the motor 12.

In such an application it is beneficial to locate the tab 38, switch 40, passageways 44, 56 and biasing means 42 on the input stage or first planetary gear set the rotational power goes through. This allows the biasing means be smaller, i.e. provide less force. If the biasing means 42 is applied to the second or third stage, the force required of the biasing means 42 would be one or two orders of magnitude larger. The exact force requirements would be dependent upon the gearing of theses subsequent stages.

The foregoing description details certain preferred embodiments of the present invention and describes the best mode contemplated. It will be appreciated, however, that changes may be made in the details of construction and the configuration of components without departing from the spirit and scope of the disclosure. Therefore, the description provided herein is to be considered exemplary, rather than limiting, and the true scope of the invention is that defined by the following claims and the full range of equivalency to which each element thereof is entitled.

What is claimed is:

1. A mechanical overload sensor system for planetary gear winch, said sensor system comprising:

a planetary gear winch having a power supply, drive motor, drive shaft, planetary gear train, case, drum and line;

a first and a second passageway located in the case and extending tangentially from the planetary gear train, the first and second passageways intersecting one another;

a biasing means contained within the first passageway capable of applying a force to the planetary gear train; and a switch located adjacent to the planetary gear train;

wherein the switch is wired to interrupt the power supply when a force from the line exceeds the force of the biasing means applied on the planetary gear train.

2. The mechanical overload sensor system of claim 1, the biasing means comprising:

a plunger;

a plunger pilot;

a spring means; and an adjustment set screw;

wherein the set screw threadedly engages the first passageway and holds the plunger pilot in place; and wherein the plunger is biased relative to the pilot plunger by the spring means.

3. The mechanical overload sensor system of claim 2, the spring means comprising a plurality of belleville washers.

4. The mechanical overload sensor system of claim 1, the planetary gear train further comprising:

a sun gear connected to a drive shaft;

a plurality of planet gears located around and engaging with the sun gear, each planet gear with a planet pin securing it to a planet carrier; and a ring gear extending around and engaging with the planet gears, the ring gear having a tab located between the switch and the biasing means.

5. The mechanical overload sensor system of claim 1 further comprising:

the first and second passageways each having an adjustment set screw, and the adjustment set screws threadedly engaging with their respective passageway.

6. The mechanical overload system of claim 5 further comprising:

the biasing means being locatable in either the first or second passageway.

7. A mechanical overload sensor system for planetary gear winch, said sensor system comprising:

a planetary gear winch having a power supply, drive motor, drive shaft, planetary gear train, case, drum and line;

a first and a second passageway located in the case and extending tangentially from the planetary gear train, the first and second passageways intersecting one another;

a biasing means contained within the first passageway capable of applying a force to a tab on the planetary gear train, the biasing means having a plunger, a plunger pilot, a spring means and an adjustment set screw, the adjustment set screw threadedly engaging the first passageway and holds the plunger pilot in place; and wherein the plunger is biased relative to the pilot plunger by the spring means; and a switch located adjacent to the tab of the planetary gear train;

wherein the switch is wired to interrupt the power supply when a force from the line exceeds the force of the biasing means applied on the tab of the planetary gear train.

8. The mechanical overload sensor system of claim 7 further comprising:

the biasing means being moveable between the first and second passageway; and the tab and switch being moveable between adjacent the first passageway and the second passageway.

9. A mechanical overload sensor system for planetary gear winch, said sensor system comprising:

a planetary gear winch including a case and a planetary gear train, the planetary gear train including planet gears and a ring gear extending around and engaging with the planet gears;

a first and a second passageway located in the case and extending tangentially from the planetary gear train, the first and second passageways intersecting one another;

a biasing means contained within one of the first and second passageways and capable of applying a force to the planetary gear train; and a switch located adjacent to the planetary gear train, wherein the switch is wired to interrupt a power supply of the planetary gear winch when a force from the line exceeds the force of the biasing means applied on the planetary gear train; and the ring gear having a tab located between the switch and the biasing means.

10. The mechanical overload sensor system of claim 9, the biasing means comprising:

a plunger;

a plunger pilot;

a spring means; and an adjustment set screw;

wherein the set screw threadedly engages the first passageway and holds the plunger pilot in place; and wherein the plunger is biased relative to the pilot plunger by the spring means.

11. The mechanical overload sensor system of claim 10, the spring means comprising a plurality of belleville washers.

12. The mechanical overload sensor system of claim 9 comprising:

the first and second passageways each having an adjustment set screw, and the adjustment set screws threadedly engaging with their respective passageway.

13. The mechanical overload sensor system of claim 9 further comprising:

the biasing means being moveable between the first and second passageway; and the tab and switch being moveable between adjacent the first passageway and the second passageway.

* * * * *